US010054389B2

(12) United States Patent
Wei

(10) Patent No.: US 10,054,389 B2
(45) Date of Patent: Aug. 21, 2018

(54) TOY GUN WITH TWO-STAGE SAFETY

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 146 days.

(21) Appl. No.: 15/368,053

(22) Filed: Dec. 2, 2016

(65) Prior Publication Data

US 2018/0156566 A1 Jun. 7, 2018

(51) Int. Cl.

| | |
|---|---|
| ***F41B 11/00*** | (2013.01) |
| ***F41B 11/70*** | (2013.01) |
| ***F41B 11/642*** | (2013.01) |
| ***F41B 11/89*** | (2013.01) |

(52) U.S. Cl.

CPC ..... *F41B 11/70* (2013.01); *F41B 11/642* (2013.01); *F41B 11/89* (2013.01)

(58) Field of Classification Search

CPC ..... F41B 11/642; F41B 11/70; F41B 11/89
See application file for complete search history.

(56) References Cited

U.S. PATENT DOCUMENTS

| | | | | |
|---|---|---|---|---|
| 2,572,176 | A * | 10/1951 | Mihalyi | F41A 17/50 124/40 |
| 4,173,964 | A * | 11/1979 | Curran | F41A 17/46 124/40 |
| 5,349,939 | A * | 9/1994 | Perrone | F41B 11/00 124/74 |
| 9,885,537 | B2 * | 2/2018 | Tippmann, Jr. | F41B 11/723 |
| 2011/0220088 | A1 * | 9/2011 | Maggiore | A01M 3/00 124/76 |
| 2013/0263840 | A1 * | 10/2013 | Maeda | F41B 11/721 124/76 |
| 2014/0000578 | A1 * | 1/2014 | Huang | F41B 11/70 124/72 |

* cited by examiner

*Primary Examiner* — Gabriel J. Klein
(74) *Attorney, Agent, or Firm* — Chun-Ming Shih; HDLS IPR Services

(57) ABSTRACT

A toy gun with a two-stage safety includes a gun body, a trigger press member, a two-stage safety and a trigger assembly. The pull handle is placed inside the gun body and includes a first blocker and a second blocker. The trigger press member includes a press block movably engaged with the first blocker. The two-stage safety includes a movable block, a stopper and a swing block. The stopper is movably engaged with the second blocker or returns toward the pull handle. The stopper includes a protruding portion and a protruding pillar. A side edge or a distal end of the swing block is movably engaged with the protruding pillar. The trigger assembly includes a push block and a linkage rod.

13 Claims, 14 Drawing Sheets

TOY GUN WITH TWO-STAGE SAFETY

TECHNICAL FIELD

The present invention relates to a toy gun structure and, in particular, to a toy gun with a two-stage safety.

BACKGROUND

Since people nowadays live busy and stressful lives, most people relieve their stress by leisure activities, and more and more people prefer exciting recreation activities like airsoft games. As a result, ball bullet guns (i.e. BB guns), paint guns and air guns play an important role in shooting practices.

However, conventional toy guns fire bullets/projectiles by means of compressed air in gas bottles. When a user keeps pulling a trigger, the gun cannot stop firing until the gas bottle is out of gas. Thus, even if none of the bullets/projectiles are left, the gas in the gas bottle keeps being exhausted until gas runs out, and too many bullets/projectiles may be fired accidentally to hurt people.

Therefore, it is important for the industries to design a safety structure for a toy gun in a manner such that when a trigger is pulled once, only a single-shot firing action can be achieved, and the toy gun can be switched into a single-shot firing mode or a continuous-shot firing mode by means of the safety structure.

Accordingly, the aim of the inventor is to solve the above-mentioned problems, on the basis of which the present invention is accomplished.

SUMMARY

It is an object of the present invention to provide a toy gun with a two-stage safety, for providing two safety procedures, wherein a first safety procedure is carried out by making the pull handle blocked by the press block through the first blocker, and a second safety procedure is carried out by making the pull handle blocked by the stopper through the second blocker.

Accordingly, the present invention provides a toy gun with a two-stage safety, comprising: a gun body including a slide base inside and a pull handle reciprocating horizontally on the slide base, the pull handle including a first blocker, a second blocker and a third blocker; a trigger press member including a press block, the press block pivotally connected to the gun body and movably engaged with the first blocker; a two-stage safety including a movable block, a stopper and a swing block, the movable block and the stopper being pivotally connected to the gun body, the stopper being movably engaged with the second blocker or returning toward the pull handle, the stopper including a protruding portion and a protruding pillar, the swing block being pivotally connected to the movable block, a side edge or a distal end of the swing block being movably engaged with the protruding pillar; and a trigger assembly including a push block and a linkage rod, the push block being pivotally connected to the gun body and movable to push the press block or the stopper, the linkage rod being pivotally connected to the gun body and movable to push the push block, wherein when the linkage rod drives the push block to be released from the protruding portion, the third block pushes the swing block, and the side edge of the swing block is brought into engagement with the protruding pillar, so that the stopper returns toward the pull handle to be engaged with the second blocker.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
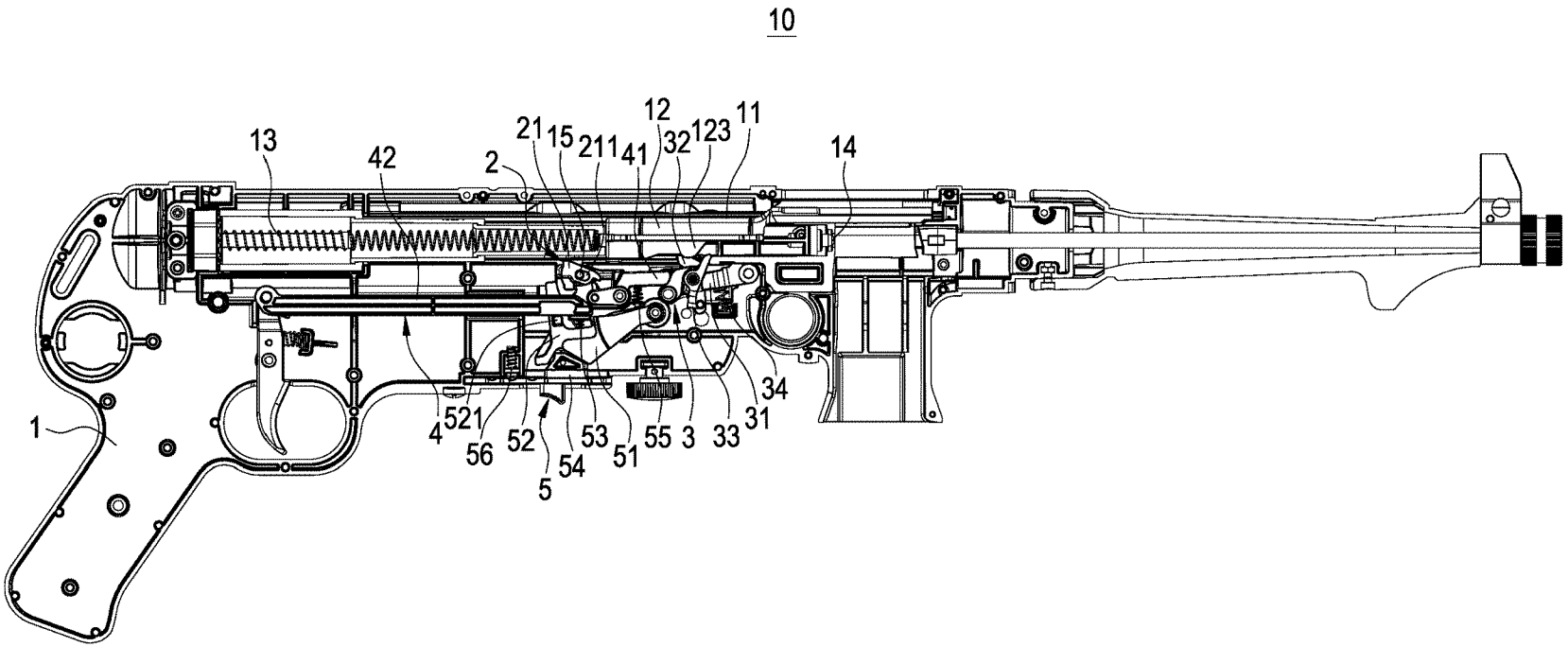
FIG. 1 is an assembled view illustrating a toy gun according to the present invention.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 14, the present invention provides a toy gun with a two-stage safety. The toy gun 10 includes a gun body 1, a trigger press member 2, a two-stage safety 3, and a trigger assembly 4.

The gun body 1 includes a slide base 11 inside and a pull handle 12 reciprocating horizontally on the slide base 11. One end of the pull handle 12 is connected to the slide base 11 by means of a restoration spring 13, and the other end of the pull handle 12 includes a firing pin 14. The pull handle 12 includes a first blocker 121, a second blocker 122 and a third blocker 123. The second blocker 122 is disposed between the first blocker 121 and the third blocker 123. A pivot pillar 15 extends from the gun body 1.

The trigger press member 2 includes a press block 21 and a first spring 22. The press block 21 includes an elongated hole 211, the pivot pillar 15 is pivotally connected with and slidable in the elongated hole 211, and thereby the press block 21 is pivotally connected to the gun body 1 and movably engaged with the first blocker 121. The first spring 22 is connected to the gun body 1 to push the press block 21 to return toward the pull handle 12.

The two-stage safety 3 includes a movable block 31, a stopper 32 and a swing block 33. The movable block 31 and the stopper 32 are pivotally connected to the gun body 1. The stopper 32 is movably engaged with the second blocker 122 or returns toward the pull handle 12. The stopper 32 includes a protruding portion 321 and a protruding pillar 322. The swing block 33 is pivotally connected to the movable block 31, and a side edge 331 or a distal end 332 of the swing block 33 is movably engaged with the protruding pillar 322.

In detail, the two-stage safety 3 further includes a second spring 34 and a third spring 35. The second spring 34 is connected to the gun body 1 to push the stopper 32 to return toward the pull handle 12, and the third spring 35 is connected to the movable block 31 to push the swing block 33 to rotate and return toward the protruding pillar 322.

The trigger assembly 4 includes a push block 41 and a linkage rod 42, the push block 41 is pivotally connected to the gun body 1 and movable to push the press block 21 or the protruding portion 321. The linkage rod 42 is pivotally connected to the gun body 1 and movable to push the push block 41. The linkage rod 42 includes a groove 421.

The toy gun 10 of the present invention further includes a switch assembly 5. The switch assembly 5 includes a first drive block 51, a second drive block 52, a fourth spring 53, and a switch block 54, a fifth spring 55, and a resilient latch 56. The first drive block 51 is pivotally connected to the gun body 1 and movably engaged with the linkage rod 42. The second drive block 52 is assembled to the gun body 1, and the second drive block 52 is movably engaged with the press block 21 to drive the press block 21 to engage the push block 41. A protruding block 521 extends from the second drive block 52. The fourth spring 53 is connected between the gun body 1 and the second drive block 52, and the fourth spring 53 pushes the second drive block 52 to return in a direction away from the linkage rod 42. The switch block 54 is assembled to the gun body 1 and movably pushes the first drive block 51 or the second drive block 52. The fifth spring 55 is connected between the push block 41 and the first drive block 51, and the fifth spring 55 pushes the push block 41 to return toward the pull handle 12. The switch block 54 includes a plurality of recesses 541, and the resilient latch 56 is assembled to the gun body 1 and is engaged with one of the recesses 541.

Figure 2:
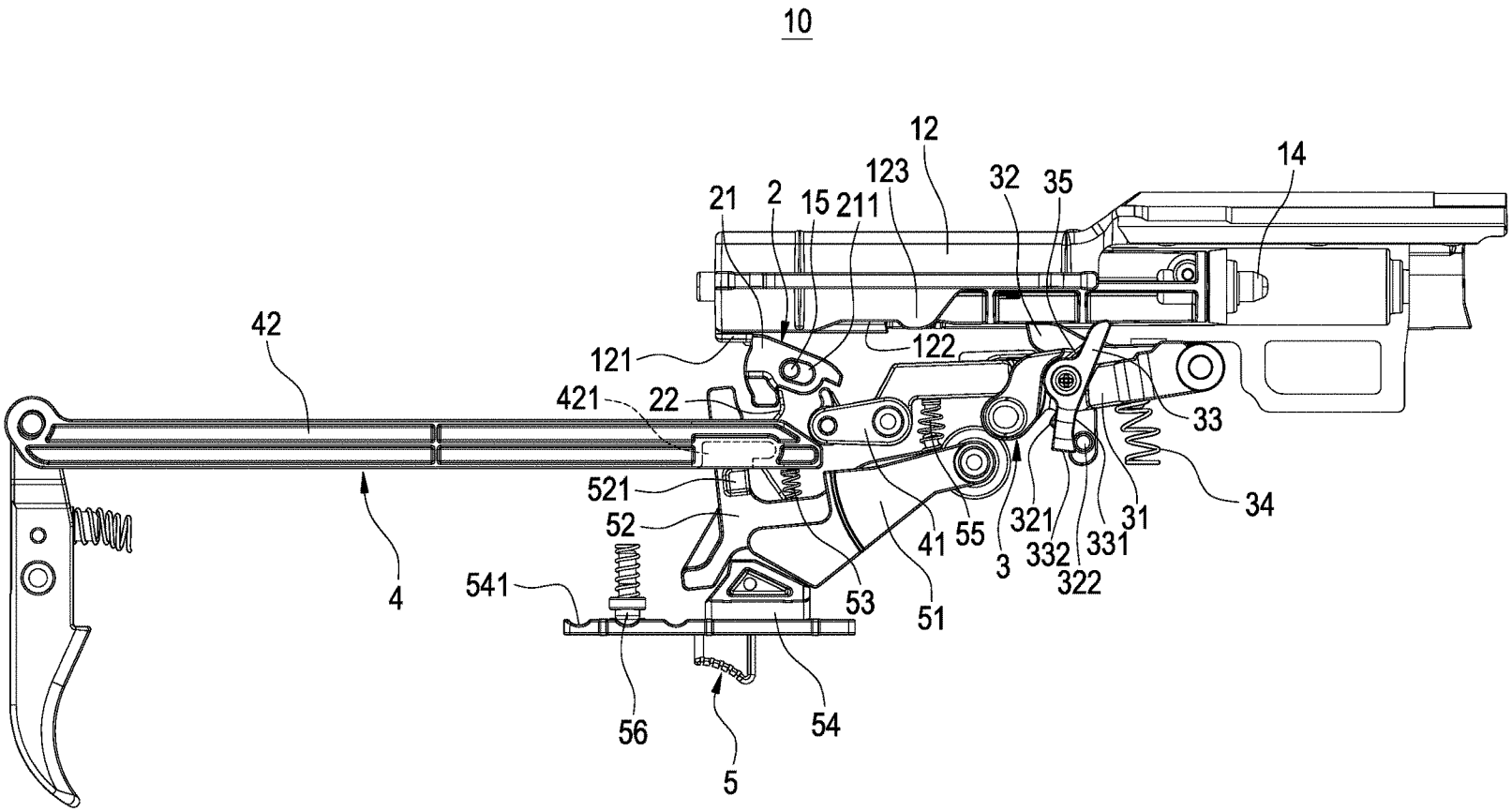
FIG. 2 is a first in-use view illustrating the toy gun in a single-shot firing position.

Please refer to FIGS. 2 to 7, showing in-use views of the toy gun 10 in a single-shot firing position. A first step of the single-shot firing action is shown in FIG. 2. When the switch block 54 moves to a single-shot firing position between the first drive block 51 and the second drive block 52, the switch block 54 does not push the first drive block 51 and the second drive block 52. The pull handle 12 moving toward the restoration spring 13 (see FIG. 1) is called a pulling handle action which brings the first blocker 121 into engagement with the press block 21.

Figure 3:
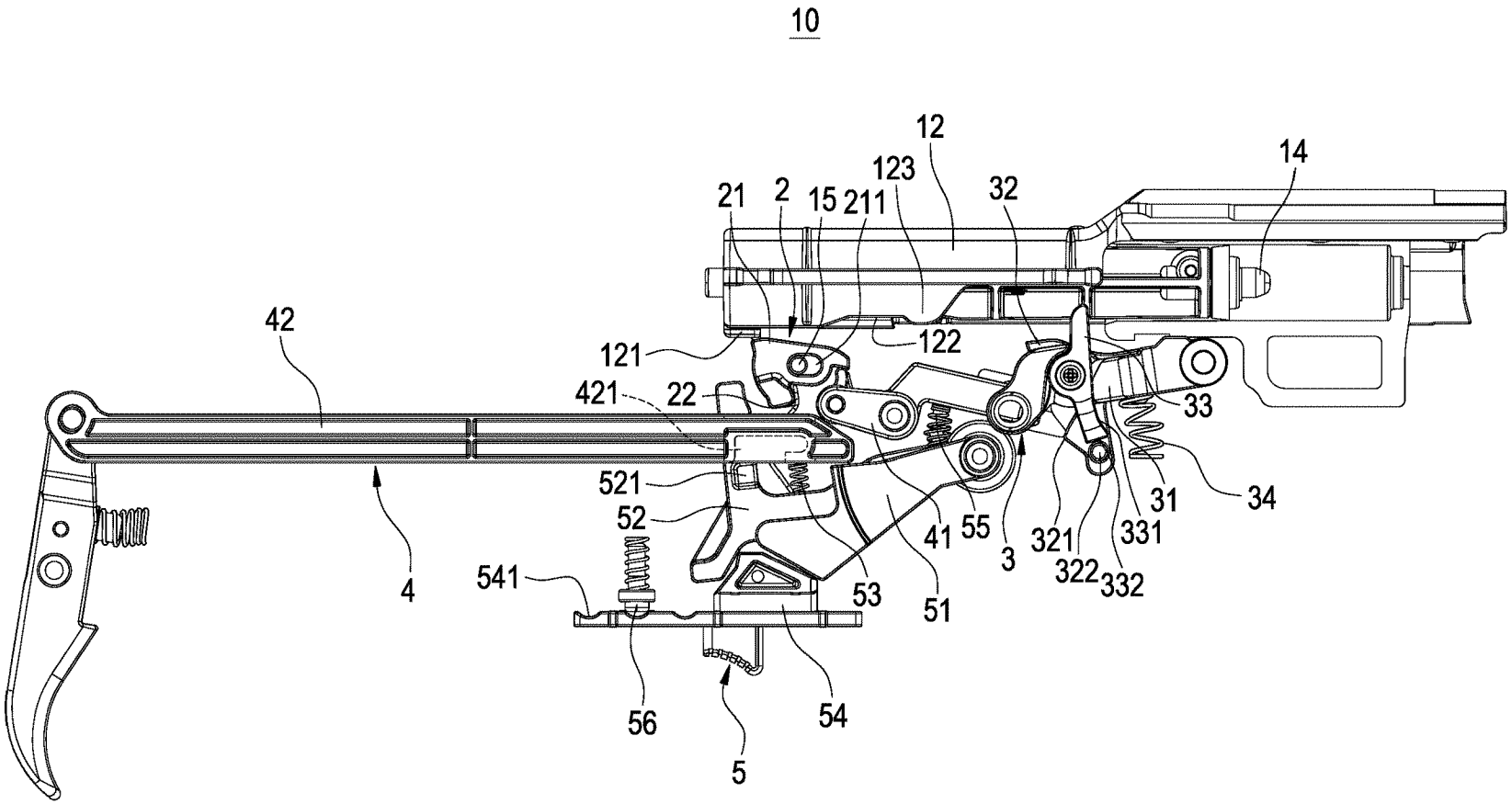
FIG. 3 is a second in-use view illustrating the toy gun in the single-shot firing position.
Figure 4:
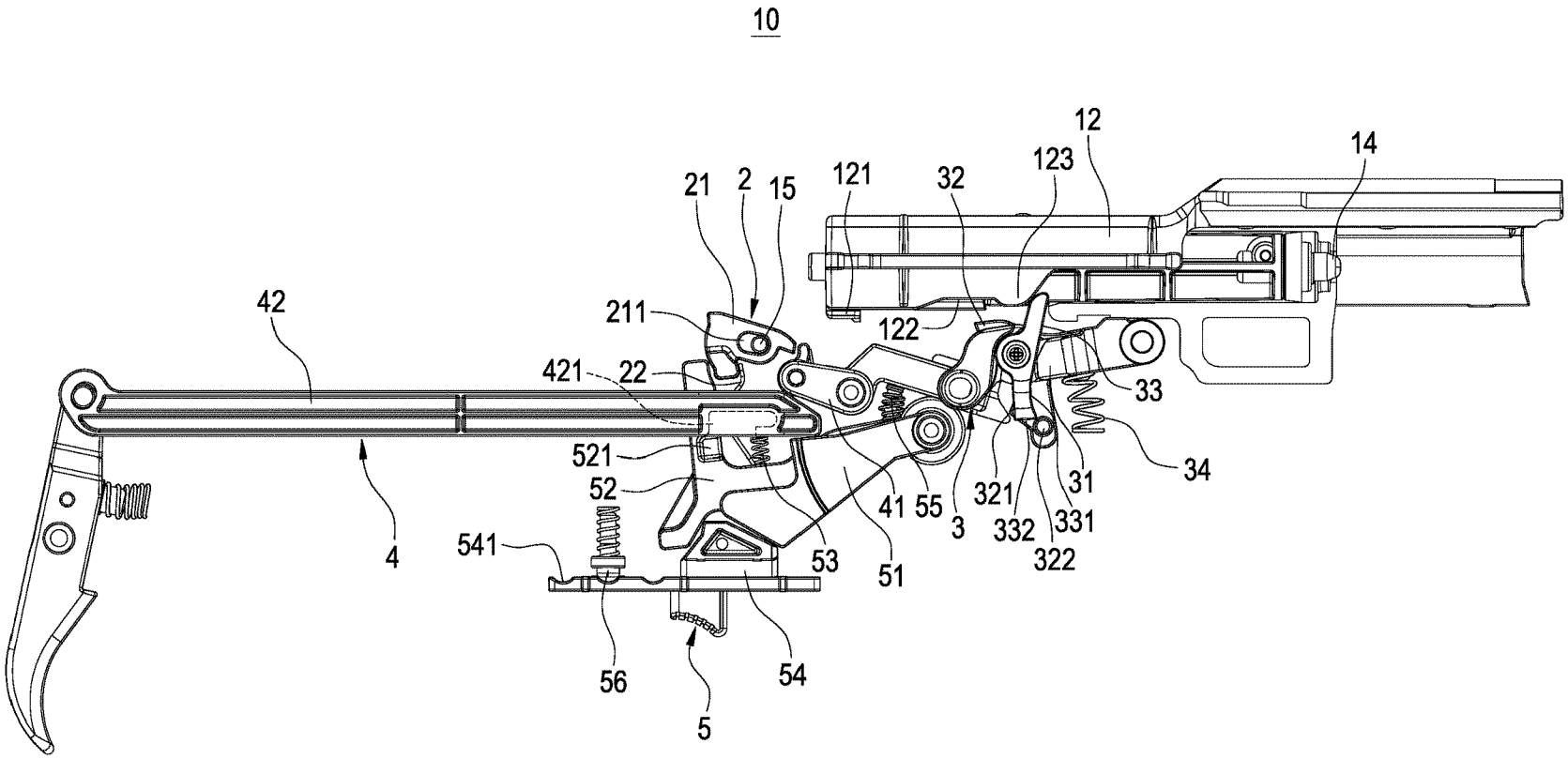
FIG. 4 is a third in-use view illustrating the toy gun in the single-shot firing position.
Figure 5:
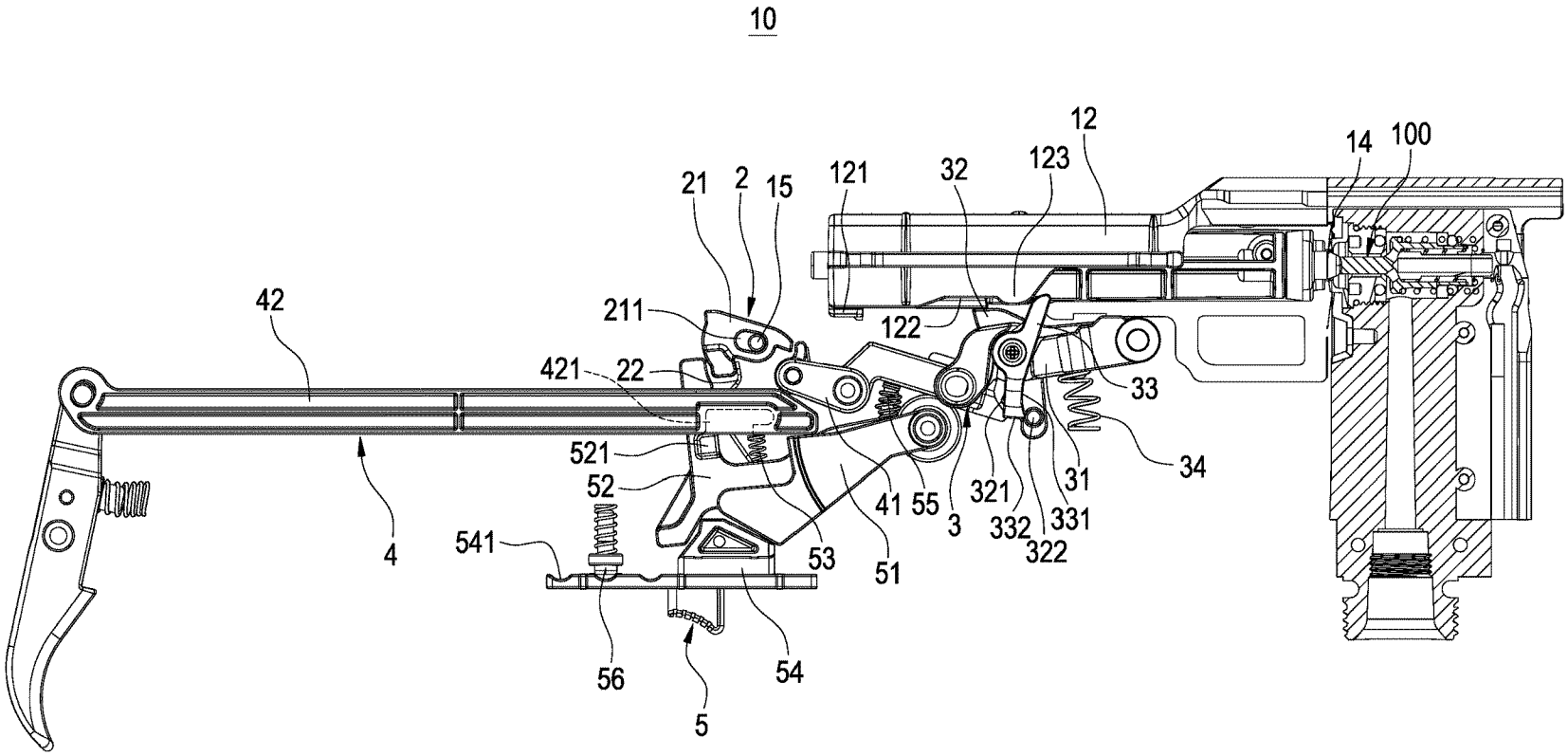
FIG. 5 is a fourth in-use view illustrating the toy gun in the single-shot firing position.

A second step of the single-shot firing action is shown in FIGS. 3 to 5. When the switch block 54 is in the single-shot firing position, and linkage rod 42 is pulled, the linkage rod 42 drives the push block 41 to push the press block 21, so that the first blocker 121 is separated from the press block 21, and the restoration spring 13 (see FIG. 1) pushes the firing pin 14 of the pull handle 12 to hit a gas supply structure 100.

Furthermore, the linkage rod 42 drives the push block 41 to push the protruding portion 321, so that the distal end 332 of the swing block 33 is brought into engagement with the protruding pillar 322. Thus, the stopper 32 is blocked by the swing block 33, and the stopper 32 cannot return toward the pull handle 12 to engage the second blocker 122.

A third step of the single-shot firing action is shown in FIG. 5. The first spring 22 first pushes the press block 21, through the elongated hole 211, to separate the press block 21 from the push block 41. Then, the press block 21 is pushed by the first spring 22 to return toward the pull handle 12 to be engaged with the first blocker 121.

Moreover, the protruding block 521 is not inserted in the groove 421, so the linkage rod 42 keeps pushing in a direction toward the push block 41, and thereby the push block 41 is depressed further until it is separated from the protruding portion 321. When the push block 41 is released from pushing the protruding portion 321, the third blocker 123 pushes the swing block 33, and thereby the side edge 331 of the swing block 33 is engaged with the protruding pillar 322, so that the stopper 32 returns toward the pull handle 12 to be engaged with the second blocker 122.

Figure 6:
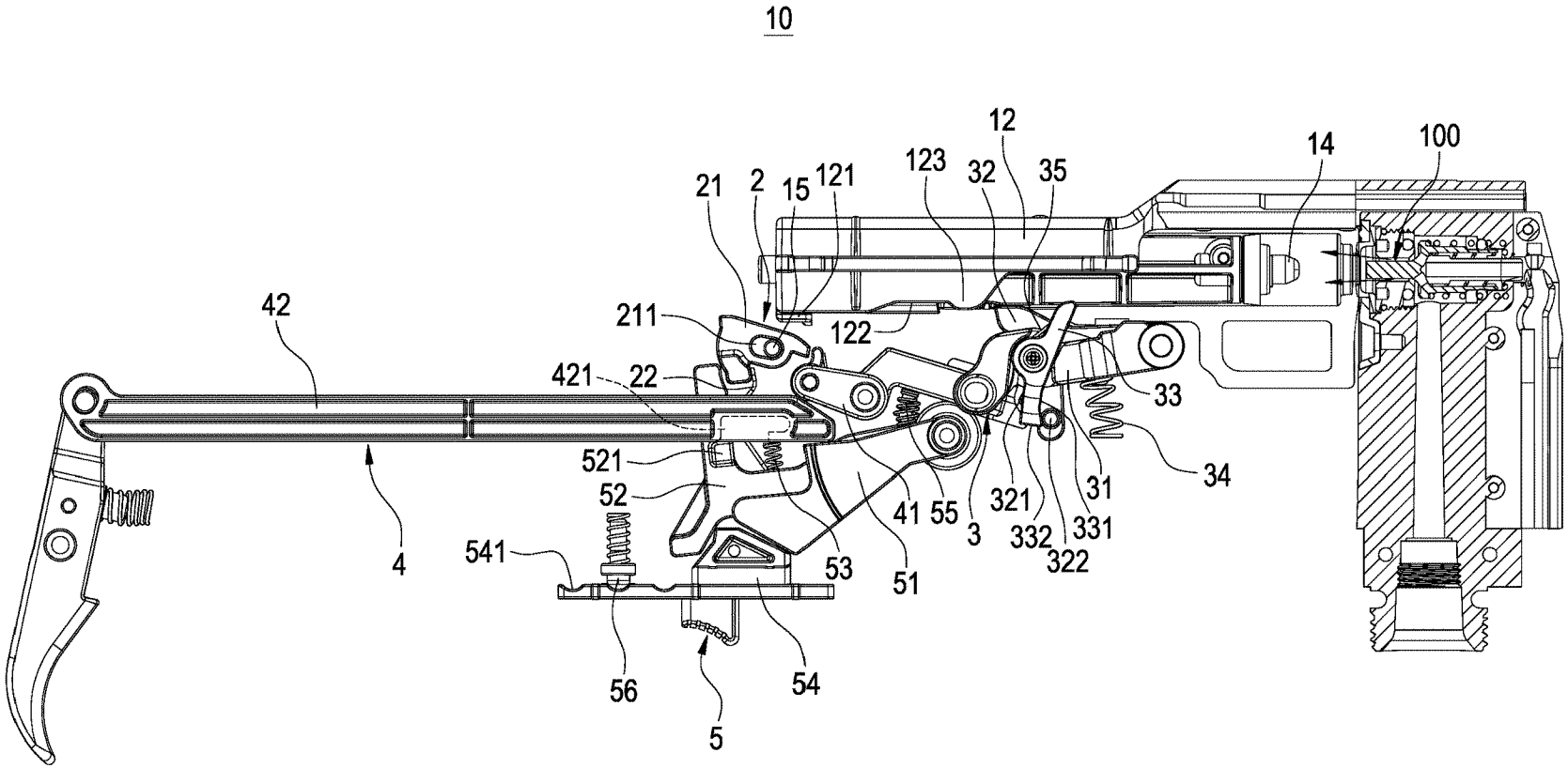
FIG. 6 is a fifth in-use view illustrating the toy gun in the single-shot firing position.
Figure 7:
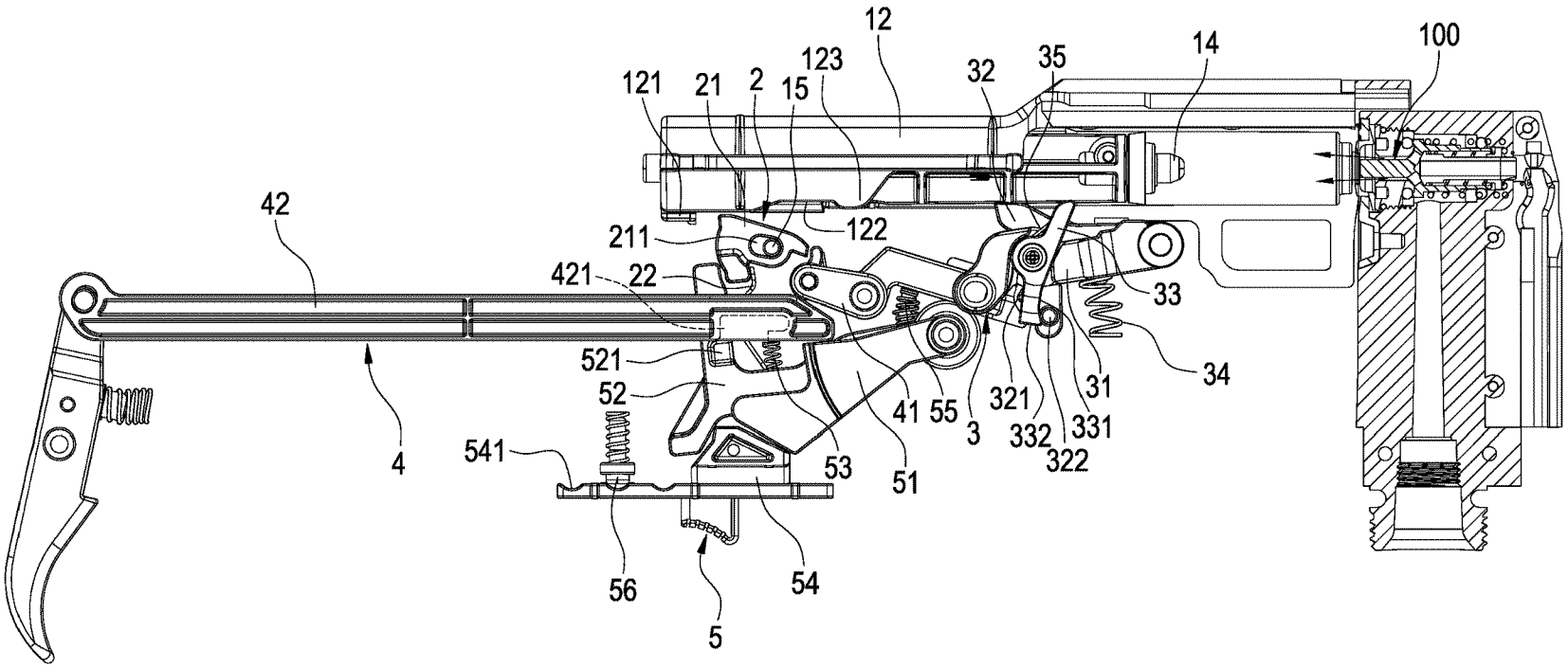
FIG. 7 is a sixth in-use view illustrating the toy gun in the single-shot firing position.

A fourth step of the single-shot firing action is shown in FIGS. 6 and 7. The press block 21 returns toward the pull handle 12 and is ready to be engaged with the first blocker 121. The stopper 32 returns toward the pull handle 12 and is ready to be engaged with the second blocker 122.

To be specific, as shown in FIG. 6, if the gas supply structure 100 discharges an insufficient amount of gas toward the pull handle 12, the pull handle 12 will be moved back a short distance, and consequently, the first blocker 121 cannot be engaged with the press block 21, but the second blocker 122 can be engaged with the stopper 32, so that the pull handle 12 is blocked by the stopper 32 through the second blocker 122, the firing pin 14 of the pull handle 12 is prevented from hitting the gas supply structure 100 again, and therefore the single-shot firing action is achieved.

Referring to FIG. 7, if the gas supply structure 100 discharges a sufficient amount of gas toward the pull handle 12, the pull handle 12 will move back a long distance, and consequently, the first blocker 121 can be engaged with the press block 21, so that the pull handle 12 is blocked by the press block 21 through the first blocker 121, the firing pin 14 of the pull handle 12 is prevented from hitting again the gas supply structure 100, and therefore the single-shot firing action is achieved.

Figure 8:
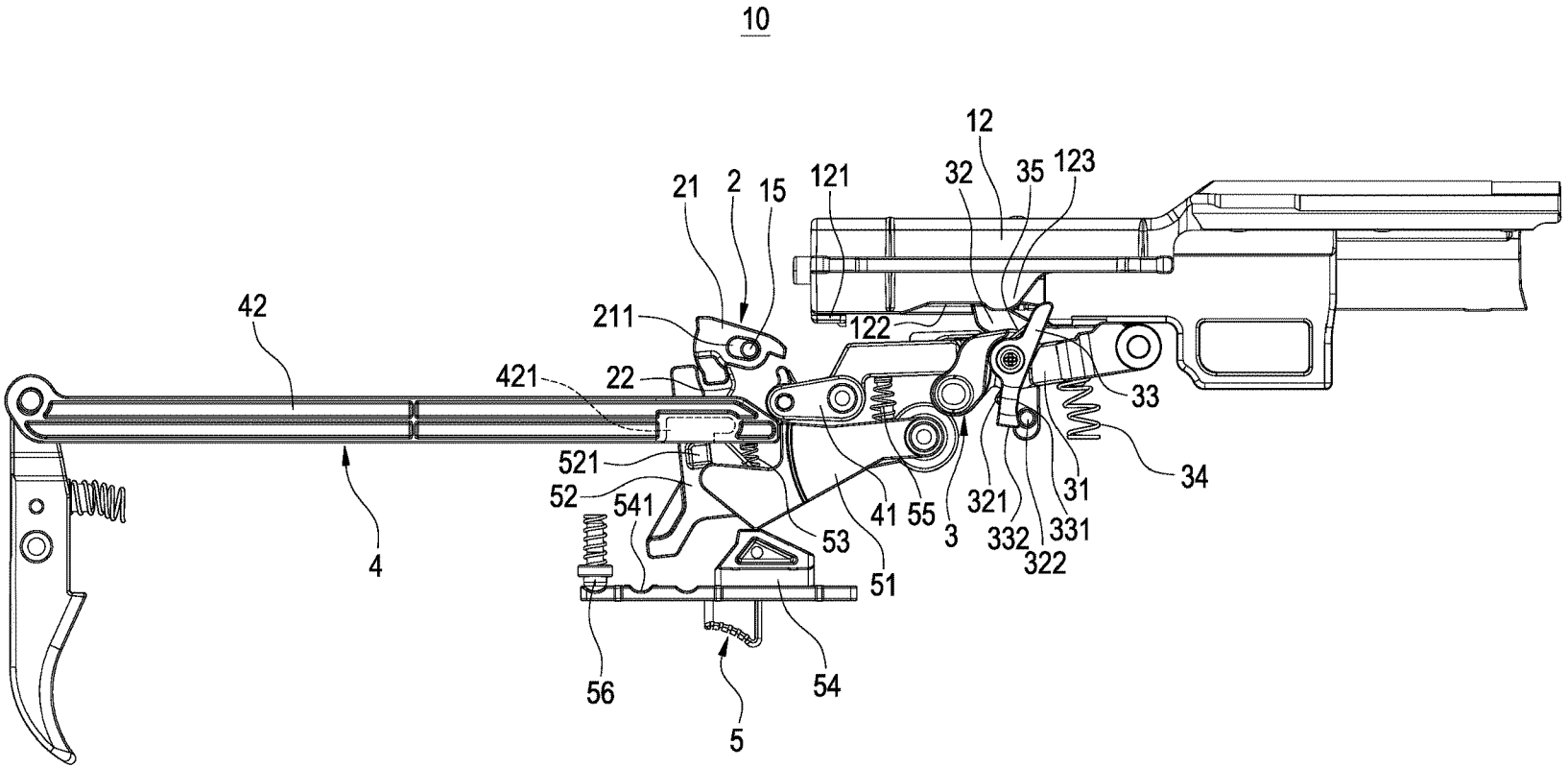
FIG. 8 is an in-use view illustrating the toy gun in a locked position.

Please refer to FIG. 8, showing the toy gun 10 in a locked position. When the switch block 54 moves to push the first drive block 51, the switch block 54 is in a locked position. The first drive block 51 is engaged with the linkage rod 42, so that the linkage rod 42 is blocked by the first drive block 51, and as a result, the linkage rod 42 cannot push the push block 41.

Figure 9:
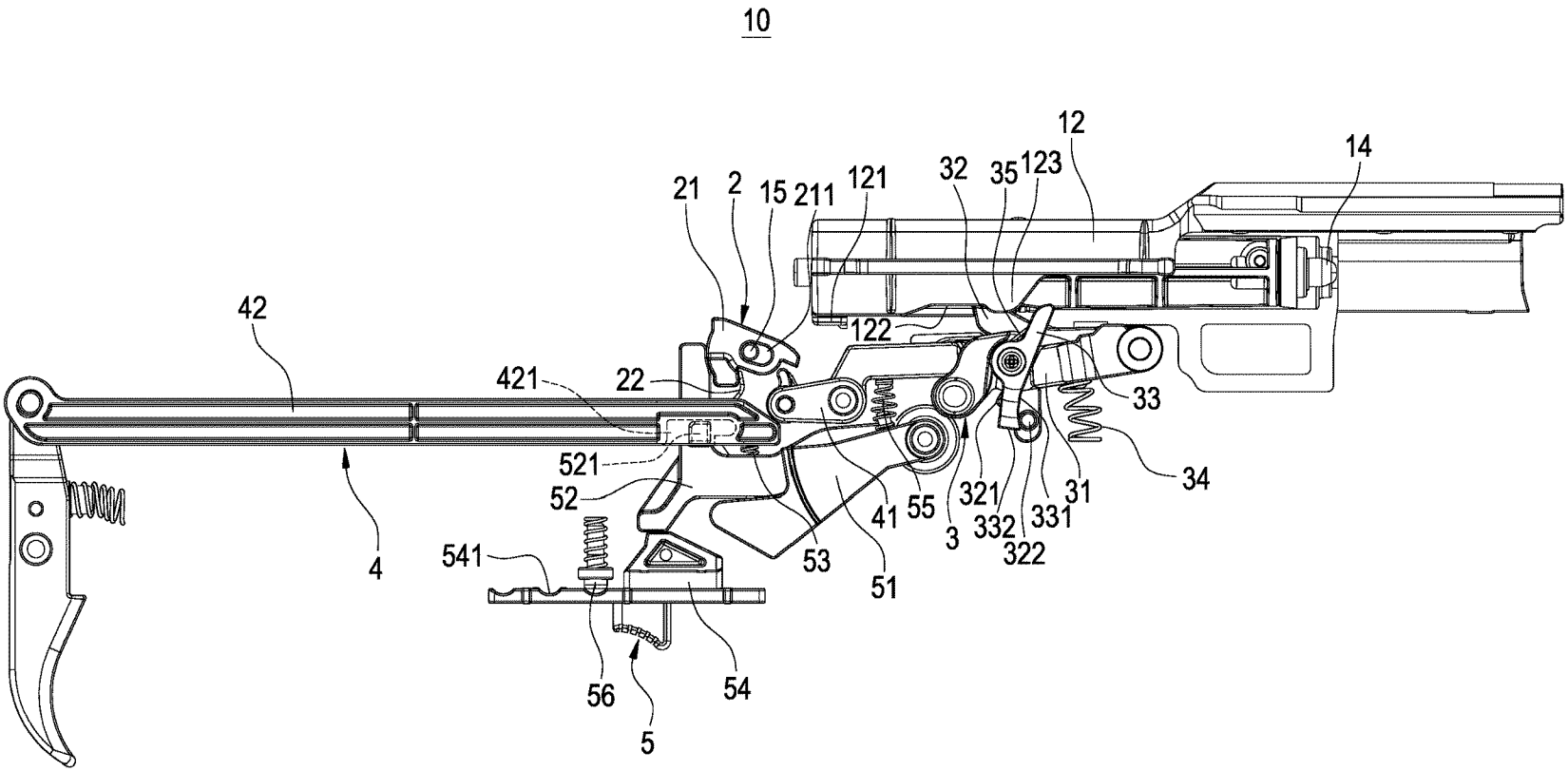
FIG. 9 is a first in-use view illustrating the toy gun in a continuous-shot firing position.
Figure 10:
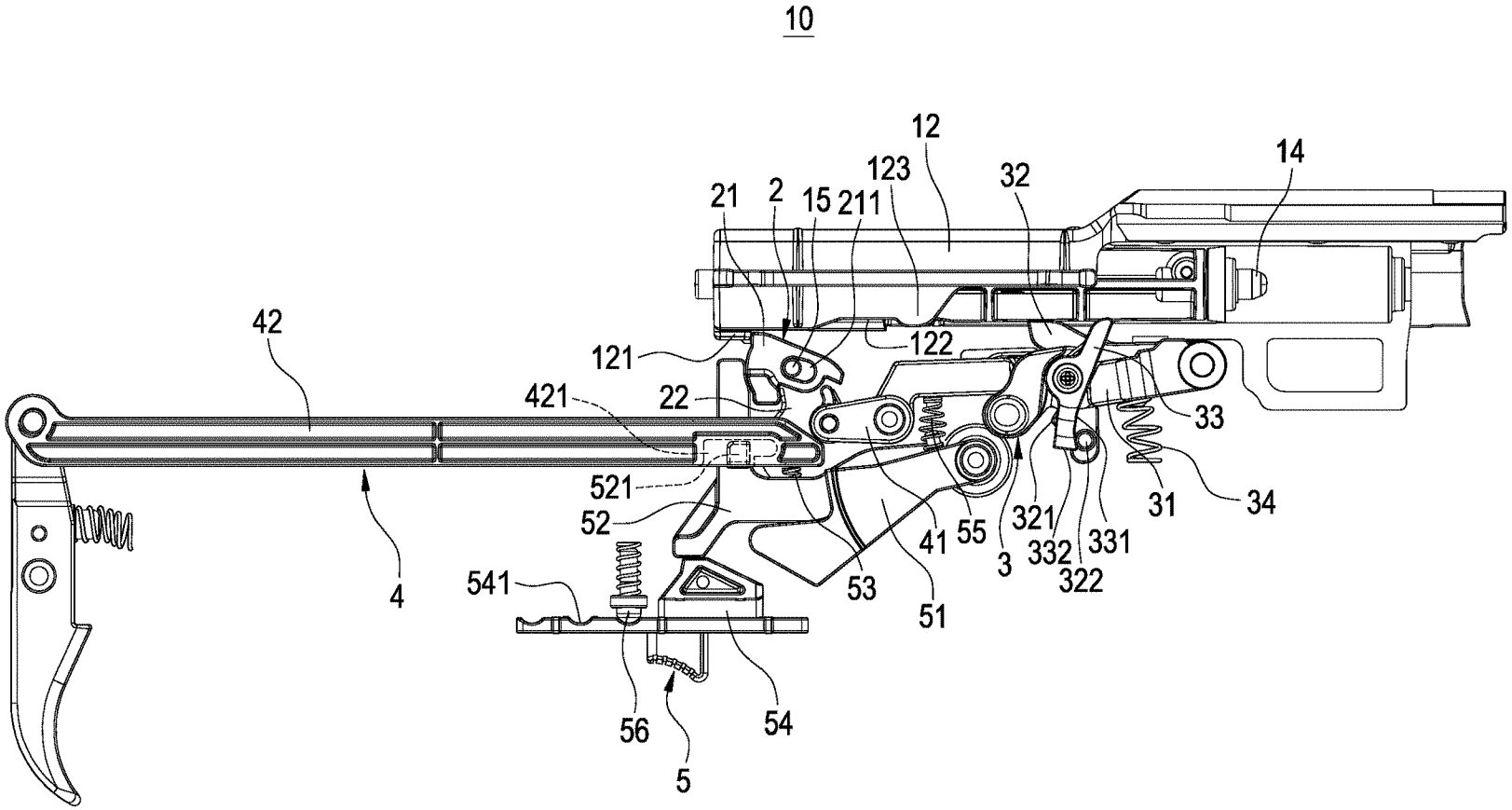
FIG. 10 is a second in-use view illustrating the toy gun in the continuous-shot firing position.

Please refer to FIGS. 9 to 14, showing in-use views of the toy gun in a continuous-shot firing position. A first step of the continuous-shot firing action is shown in FIGS. 9 and 10. When the switch block 54 moves to push the second drive block 52, the switch block 54 is in a continuous-shot firing position. The second drive block 52 drives the press block 21 to engage the push block 41. The pull handle 12 moving toward the restoration spring 13 (see FIG. 1) is called a pulling handle action which brings the first blocker 121 into engagement with the press block 21.

Figure 11:
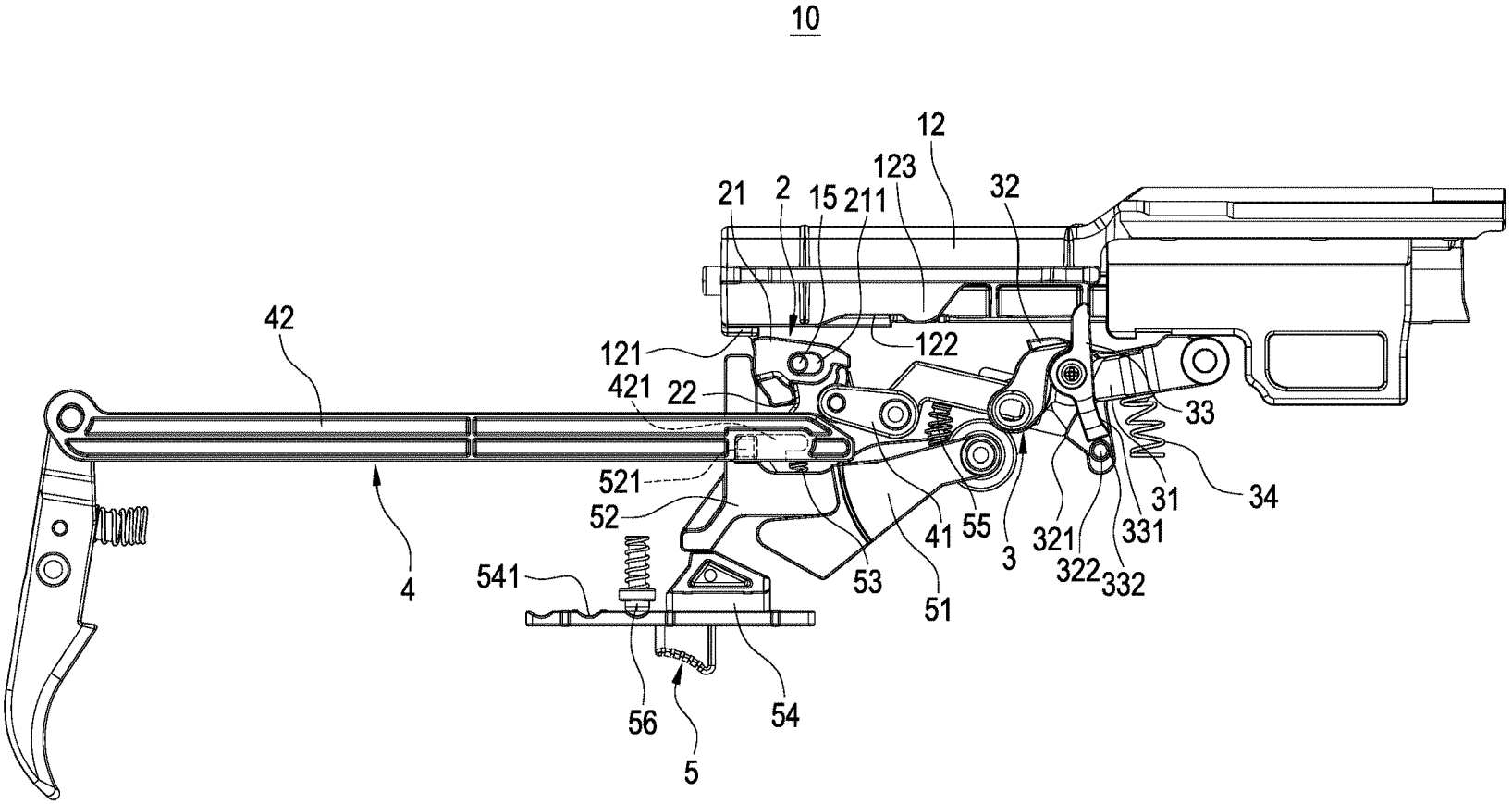
FIG. 11 is a third in-use view illustrating the toy gun in the continuous-shot firing position.
Figure 12:
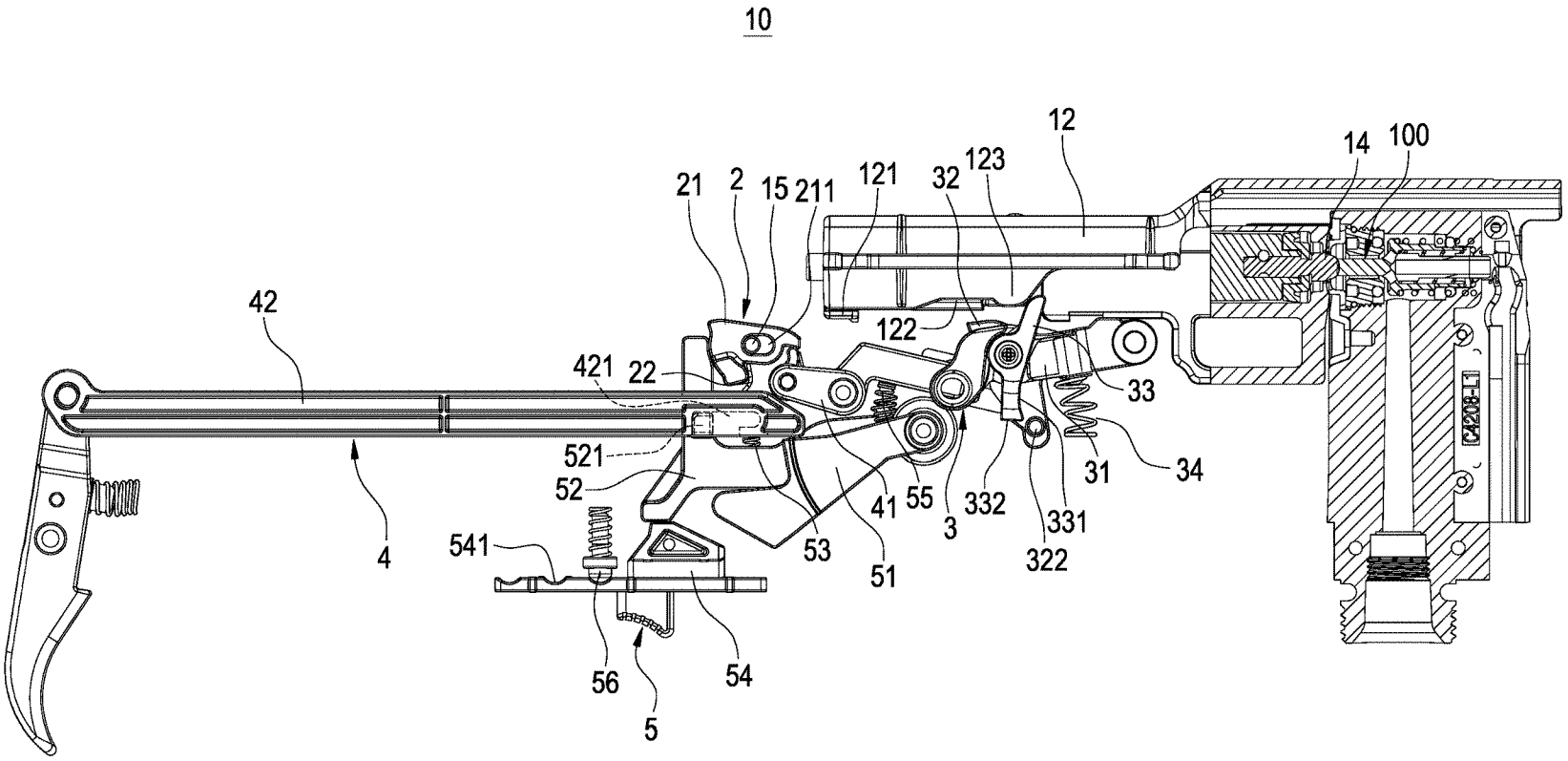
FIG. 12 is a fourth in-use view illustrating the toy gun in the continuous-shot firing position.
Figure 13:
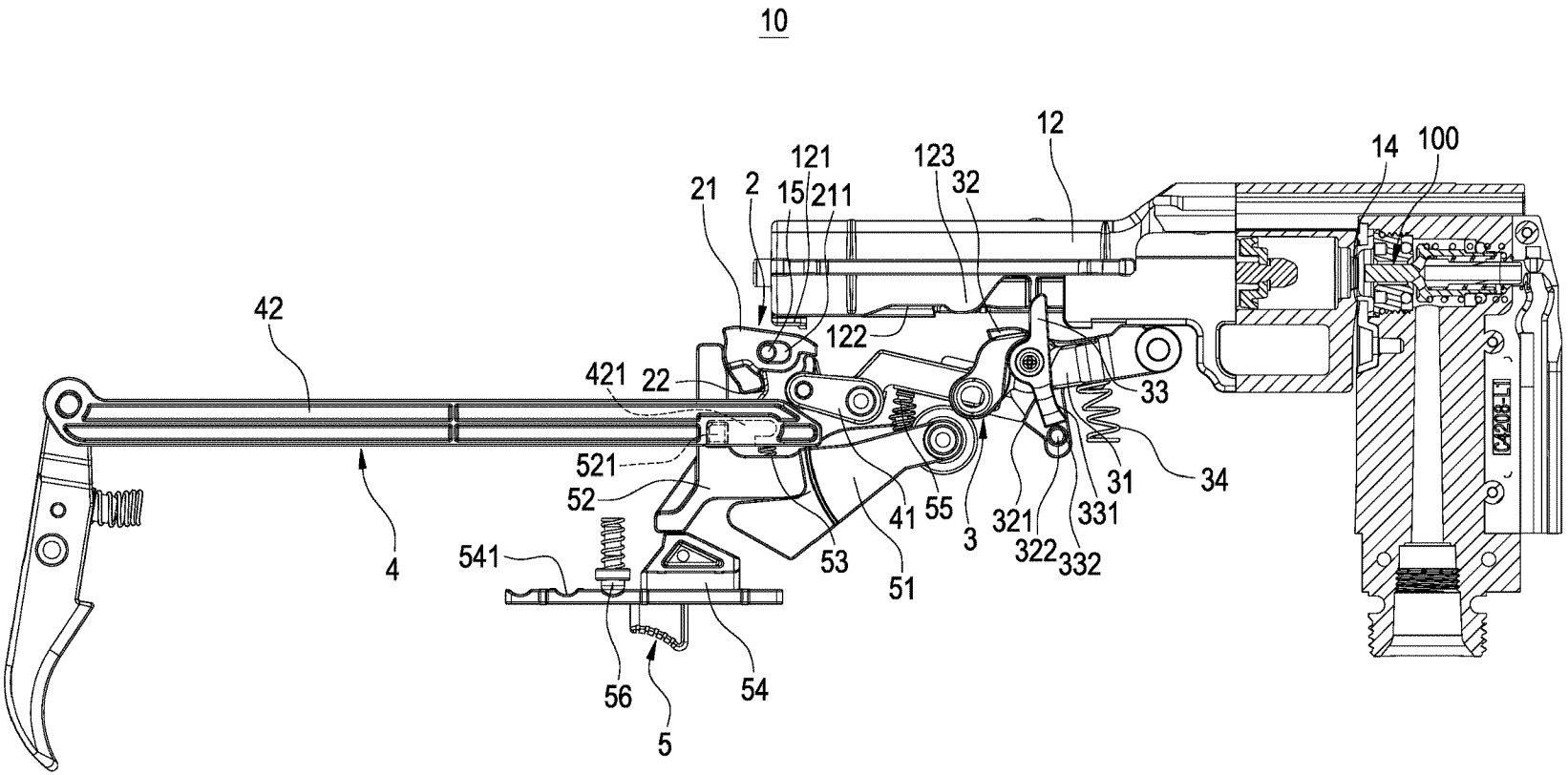
FIG. 13 is a fifth in-use view illustrating the toy gun in the continuous-shot firing position.

A second step of the continuous-shot firing action is shown in FIGS. 11 to 13. When the switch block 54 pushes the second drive block 52, the protruding block 521 is inserted in the groove 421, so that the linkage rod 42 is blocked by the protruding block 521. That is to say, a moving course of the linkage rod 42 is restricted by the protruding block 521, so that the linkage rod 42 can only push the push block 41 in a shortened distance, thereby the linkage rod 42 drives the push block 41 to keep pushing the protruding portion 321 of the two-stage safety 3, and as a result, the stopper 32 cannot return toward the pull handle 12 to engage the second blocker 122.

To be specific, as shown in FIG. 12, if the gas supply structure 100 discharges an insufficient amount of gas to the pull handle 12, the pull handle 12 will move back a short distance, and consequently, the first blocker 121 cannot be engaged with the press block 21, but the linkage rod 42 drives the push block 41 to keep pushing the protruding portion 321 of the two-stage safety 3. As a result, the stopper 32 cannot return toward the pull handle 12 and cannot engage the second blocker 122, and the firing pin 14 of the pull handle 12 will keep hitting the gas supply structure 100 until the gas supply structure 100 is out of gas, thereby achieving the continuous-shot firing action.

Referring to FIG. 13, if the gas supply structure 100 discharges a sufficient amount of gas to the pull handle 12, the pull handle 12 will move back a long distance, and then the first blocker 121 can be engaged with the press block 21, but the second drive block 52 will drive the press block 21 to move away from the pull handle 12, and consequently, the first blocker 121 cannot be engaged with the press block 21, and the firing pin 14 of the pull handle 12 keeps hitting the gas supply structure 100 until the gas supply structure 100 is out of gas, thereby achieving the continuous-shot firing action.

Figure 14:
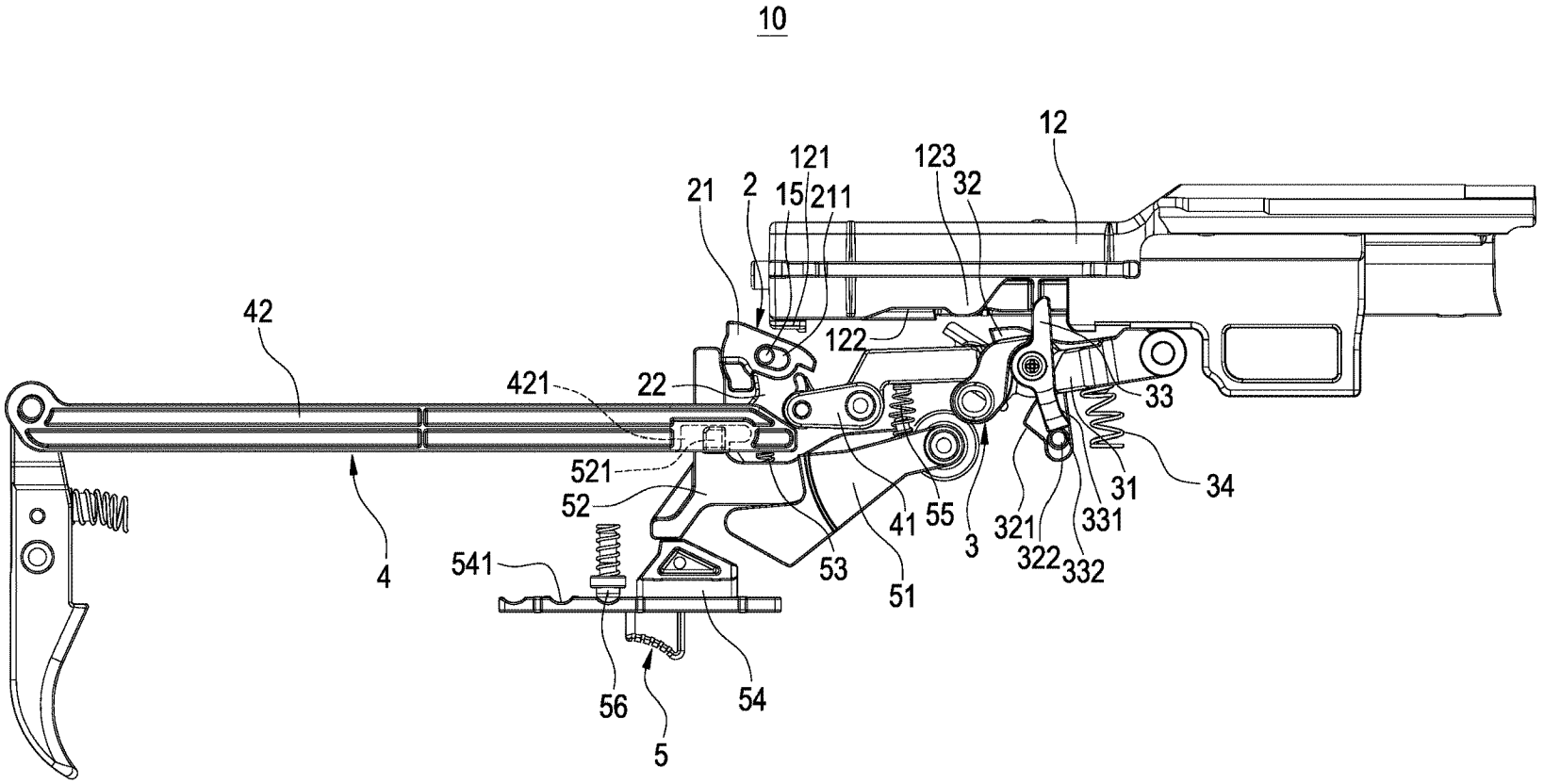
FIG. 14 is a sixth in-use view illustrating the toy gun in the continuous-shot firing position.

A third step of the continuous-shot firing action is shown in FIG. 14. By releasing the linkage rod 42, the linkage rod 42 is separated from the push rod 41, and the fifth spring 55 pushes the push block 41 to return toward the pull handle 12, so the push block 41 stops pushing the protruding portion 321 and returns toward the pull handle 12, the first spring 22 pushes the press block 21 to return toward the pull handle 12, and then the first blocker 121 can be engaged with the press block 21, and thereby the pull handle 12 is blocked by the press block 21 by means of the first blocker 121. If the gas supply structure 100 discharges an insufficient amount of gas to the pull handle 12, the pull handle 12 moves back a short distance, and then the first blocker 121 cannot be engaged with the press block 21. At this point, the third blocker 123 pushes the swing block 33, and the side edge 331 of the swing block 33 is thereby engaged with the protruding pillar 322, so that the stopper 32 returns toward the pull handle 12 to be engaged with the second blocker 122, the pull handle 12 is blocked by the stopper 32 through the second blocker 122, and thereby the firing pin 14 of the pull handle 12 is prevented from hitting the gas supply structure 100, and the toy gun 10 stops firing.

Accordingly, by utilizing a first safety procedure carried out by making the pull handle 12 blocked by the press block 21 through the first blocker 121 and utilizing a second safety procedure carried out by making the pull handle 12 blocked by the stopper 32 through the second blocker 122, the toy gun 10 has two safety procedures for the single-shot firing action.

Furthermore, by utilizing the switch assembly 5, the toy gun 10 of the present invention can be switched into the locked mode, the single-shot firing mode, or the continuous-shot firing mode.

Moreover, the switch block 54 includes multiple recesses 541. The resilient latch 56 can be engaged with one of the recesses 541, so that the switch assembly 5 can be switched between different positions with excellent stability, and great tactile sensations are provided.

In summary, the toy gun with the two-stage safety of the present invention certainly can achieve anticipated objectives and solve the conventional defects. The present invention also has industrial applicability, novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

What is claimed is:

1. A toy gun with a two-stage safety, comprising:

a gun body including a slide base inside and a pull handle reciprocating horizontally on the slide base, the pull handle including a first blocker, a second blocker and a third blocker;

a trigger press member including a press block, the press block pivotally connected to the gun body and movably engaged with the first blocker;

a two-stage safety including a movable block, a stopper and a swing block, the movable block and the stopper being pivotally connected to the gun body, the stopper being movably engaged with the second blocker or returning toward the pull handle, the stopper including a protruding portion and a protruding pillar, the swing block being pivotally connected to the movable block, a side edge or a distal end of the swing block being movably engaged with the protruding pillar; and a trigger assembly including a push block and a linkage rod, the push block being pivotally connected to the gun body and movable to push the press block or the stopper, the linkage rod being pivotally connected to the gun body and movable to push the push block, wherein when the linkage rod drives the push block to be released from pushing against the protruding portion, the third blocker pushes the swing block, so that the side edge of the swing block is engaged with the protruding pillar, and thereby the stopper returns toward the pull handle to be engaged with the second blocker.

2. The toy gun with the two-stage safety of claim 1, wherein the second blocker is disposed between the first blocker and the third blocker.

3. The toy gun with the two-stage safety of claim 1, wherein one end of the pull handle is connected to the slide base by means of a restoration spring, and the other end of the pull handle includes a firing pin.

4. The toy gun with the two-stage safety of claim 3, wherein the trigger press member includes a first spring, the first spring is connected to the gun body to push the press block to return toward the pull handle; when the pull handle moves toward the restoration spring, the first blocker is brought into engagement with the press block; and when the linkage rod drives the push block to push against the press block, the first blocker is separated from the press block.

5. The toy gun with the two-stage safety of claim 4, wherein the press block includes an elongated hole, a pivot pillar extends from the gun body, and the pivot pillar is pivotally connected with and slidable in the elongated hole.

6. The toy gun with the two-stage safety of claim 1, wherein the two-stage safety further includes a second spring and a third spring, the second spring is connected to the gun body to push the stopper to return toward the pull handle, and the third spring is connected to the movable block to push the swing block to rotate and return toward the protruding pillar.

7. The toy gun with the two-stage safety of claim 1, further comprising a switch assembly, the switch assembly including a first drive block, a second drive block, a fourth spring, and a switch block, the first drive block being pivotally connected to the gun body and movably engaged with the linkage rod, the second drive block being assembled to the gun body, the second drive block being movably engaged with the press block to drive the press block to be engaged with the push block, the fourth spring being connected between the gun body and the second drive block, the fourth spring pushing the second drive block to return in a direction away from the linkage rod, the switch block being assembled to the gun body and movably pushing the first drive block or the second drive block.

8. The toy gun with the two-stage safety of claim 7, wherein the switch assembly further includes a resilient latch, the switch block includes a plurality of recesses, and the resilient latch is assembled to the gun body and is engaged with one of the recesses.

9. The toy gun with the two-stage safety of claim 7, wherein the switch assembly further includes a fifth spring, the fifth spring is connected between the push block and the first drive block, and the fifth spring pushes the push block to return toward the pull handle.

10. The toy gun with the two-stage safety of claim 9, wherein when the switch block moves to a single-shot firing position between the first drive block and the second drive block, the switch block does not push the first drive block and the second drive block, so that the linkage rod drives the push block to push against the protruding portion.

11. The toy gun with the two-stage safety of claim 9, wherein when the switch block moves to a locked position to push the first drive block, the first drive block is engaged with the linkage rod, so that the linkage rod is blocked by the first drive block.

12. The toy gun with the two-stage safety of claim 9, wherein when the switch block moves to a continuous-shot firing position to push the second drive block, the second drive block drives the press block to be engaged with the push block, and when the linkage rod drives the push block to push against the protruding portion, the push block is driven by the press block and the linkage rod to keep pushing the protruding portion, so that the distal end of the swing block is brought into engagement with the protruding pillar, and the stopper is thereby blocked by the swing block.

13. The toy gun with the two-stage safety of claim 12, wherein the linkage rod includes a groove, a protruding block extends from the second drive block, and when the switch block pushes the second drive block, the protruding block is inserted in the groove, so that the linkage rod is blocked by the protruding block.

* * * * *